US006218071B1

(12) United States Patent
Tutt et al.

(10) Patent No.: US 6,218,071 B1
(45) Date of Patent: Apr. 17, 2001

(54) ABRASION-RESISTANT OVERCOAT LAYER FOR LASER ABLATIVE IMAGING

(75) Inventors: Lee William Tutt; Sharon Wheten Weber, both of Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/295,315

(22) Filed: Aug. 24, 1994

(51) Int. Cl.[7] ..... G03C 1/72; B41M 5/24

(52) U.S. Cl. ..... 430/269; 430/945; 430/201; 430/200; 503/227; 428/195; 428/206

(58) Field of Search ..... 430/945, 269, 430/270, 200, 201, 270.1; 503/227; 8/471; 428/195, 206, 913, 94

(56) References Cited

U.S. PATENT DOCUMENTS 4,716,144 * 12/1987 Vanier et al. ..... 430/945
4,734,397 * 3/1988 Harrison et al. ..... 503/227
4,772,582 * 9/1988 DeBoer ..... 430/201
4,892,860 * 1/1990 Vanier ..... 503/227
4,973,572 * 11/1990 DeBoer ..... 430/200
5,171,650 12/1992 Ellis et al. ..... 430/20
5,246,909 * 9/1993 Thien et al. ..... 430/201
5,256,506 * 10/1993 Ellis et al. ..... 430/201
5,273,857 * 12/1993 Neumann et al. ..... 430/201
5,278,023 * 1/1994 Bills et al. ..... 430/201
5,283,224 * 2/1994 Neumann ..... 430/201
5,330,876 * 7/1994 Kaszczuk et al. ..... 430/270

* cited by examiner

*Primary Examiner*—Martin Angebranndt
(74) *Attorney, Agent, or Firm*—Harold E. Cole

(57) ABSTRACT

A laser dye-ablative recording element comprising a support having thereon, in order, a dye layer comprising an image dye dispersed in a polymeric binder and a polymeric overcoat which contains spacer beads but which does not contain any image dye, the dye layer having an infrared-absorbing material associated therewith to absorb at a given wavelength of the laser used to expose the element, the image dye absorbing in the region of the electromagnetic spectrum of from about 300 to about 700 nm and not having substantial absorption at the wavelength of the laser used to expose the element.

5 Claims, No Drawings

ABRASION-RESISTANT OVERCOAT LAYER FOR LASER ABLATIVE IMAGING

This invention relates to single-sheet, monocolor elements for laser-induced, dye-ablative imaging and, more particularly, to scratch- and abrasion-resistant matte overcoats for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off the image dye at the spot where the laser beam hits the element and leaves the binder behind. In ablative imaging, the laser radiation causes rapid local changes in the imaging layer thereby causing the material to be ejected from the layer. This is distinguishable from other material transfer techniques in that some sort of chemical change (e.g., bond-breaking), rather than a completely physical change (e.g., melting, evaporation or sublimation), causes an almost complete transfer of the image dye rather than a partial transfer. Usefulness of such an ablative element is largely determined by the efficiency at which the imaging dye can be removed on laser exposure. The transmission Dmin value is a quantitative measure of dye clean-out: the lower its value at the recording spot, the more complete is the attained dye removal.

Laser-ablative elements are described in detail in co-pending U.S. Ser. No. 99,969, filed Jul. 30, 1993, by Chapman et al., the disclosure of which is hereby incorporated by reference. There is a problem with these elements in that they are subject to physical damage from handling and storage.

U.S. Pat. No. 5,171,650 relates to an ablation-transfer image recording process. In that process, an element is employed which contains a dynamic release layer which absorbs imaging radiation which in turn is overcoated with an ablative carrier overcoat which contains a "contrast imaging material", such as a dye. An image is transferred to a receiver in contiguous registration therewith. However, there is no disclosure in that patent that the process should be conducted in the absence of a receiver, or that there should be an overcoat layer on the element which does not contain an image dye.

In co-pending application Ser. No. 08/283,880 of Kaszczuk et al. filed Aug. 1, 1994, a polymeric protective overcoat is applied to the surface of a laser ablative imaging element prior to the laser-writing process. There is a problem with this element, however, in that the scratch and abrasion resistance could be improved.

It is an object of this invention to provide an ablative recording element which has improved scratch resistance and a matte finish to reduce fingerprinting and glare. It is another object of this invention to provide an ablative single-sheet process which does not require a separate receiving element.

These and other objects are achieved in accordance with the invention which relates to a laser dye-ablative recording element comprising a support having thereon, in order, a dye layer comprising an image dye dispersed in a polymeric binder and a polymeric overcoat which contains spacer beads but which does not contain any image dye, the dye layer having an infrared-absorbing material associated therewith to absorb at a given wavelength of the laser used to expose the element, the image dye absorbing in the region of the electromagnetic spectrum of from about 300 to about 700 nm and not having substantial absorption at the wavelength of the laser used to expose the element.

It has been found unexpectedly that an overcoat containing spacer beads for a single-sheet, monocolor, laser ablative imaging element will render such an element scratch- and abrasion-resistant and provide a matte finish to reduce fingerprinting and glare. The spacer beads do not interfere in the ablation process of the image layer and, surprisingly, they may even remain on the imaged element after the ablation process. The beads serve as spacers by providing a protective gap between films stacked on top of one another.

The protective overcoat containing spacer beads applied to the surface of the ablation sheet prior to laser writing still allows the dye to be removed as well as improves the scratch-resistance and abrasion-resistance of the sheet. This is important, for example, in reprographic mask and printing mask applications where a scratch can remove fine line detail creating a defect in all subsequently exposed work. The dye removal process can be either continuous (photographic-like) or half-tone. For purposes of this invention, monocolor refers to any single dye or dye mixture used to produce a single stimulus color. The resulting single-sheet medium can be used for creating medical images, reprographic masks, printing masks, etc., or it can be used in any application where a monocolored transmission sheet is desired. The image obtained can be positive or negative.

The spacer beads employed in the overcoat layer may be employed in any concentration or particle size effective for the intended purpose. In general, the spacer beads should have a particle size ranging from about 1 to about 100 μm, preferably from about 5 to about 50 μm. The coverage of the spacer beads may range from about 0.005 to about 5.0 g/m$^2$, preferably from about 0.05 to about 0.5 g/m$^2$. The spacer beads do not have to be spherical and may be of any shape.

The spacer beads may be formed of polymers such as polystyrene, phenolic resins, melamine resins, epoxy resins, silicone resins, polyethylene, polypropylene, polytetrafluoroethylene, polyesters, polyimides, etc.; metal oxides such as silica; minerals; inorganic salts; organic pigments; waxes such as Montan wax, candelilla wax, polyethylene wax, polypropylene wax, etc. In general, the spacer beads should be inert and insensitive to heat at the temperature of use.

In a preferred embodiment of the invention, the ablative recording element contains a barrier layer between the support and the dye layer, such as those described and claimed in copending U.S. Ser. No. 08/321,282 of Topel et al., filed Oct. 11, 1994 and U.S. Ser. No. 259,586 of Pearce et al., filed Jun. 14, 1994, the disclosures of which are hereby incorporated by reference.

Another embodiment of the invention relates to a process of forming a single color, ablation image having an improved scratch resistance comprising imagewise heating by means of a laser, in the absence of a separate receiving element, the ablative recording element described above, the laser exposure taking place through the dye side of the element, and removing the ablated material, such as by means of an air stream, to obtain an image in the ablative recording element.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high UV Dmax. If it does not do this, the printing plate would not be developable to give regions which take up ink and regions which do not.

As described above, the image dye in the dye ablative recording element absorbs in the region of the electromagnetic spectrum of from about 300 to about 700 nm and does not have substantial absorption at the wavelength of the laser used to expose the element. Thus, the image dye is a different material from the infrared-absorbing material used in the element to absorb the infrared radiation and provides visible and/or UV contrast at wavelengths other than the laser recording wavelengths.

Any polymeric material may be used as the overcoat or binder which contains the spacer beads in the recording element of the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly (vinyl acetate); poly(vinyl halides) such as poly(vinyl chloride) and poly(vinyl chloride) copolymers; poly(vinyl ethers); maleic anhydride copolymers; polystyrene; poly (styrene-co-acrylonitrile); a polysulfone; a poly(phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The overcoat or binder may be used at a coverage of from about 0.1 to about 5 g/m$^2$.

In a preferred embodiment, the polymeric overcoat may be a polyurethane, cellulose nitrate, cellulose acetate propionate, gelatin or a polyacrylate.

In a preferred embodiment, the polymeric binder used in the recording element employed in process of the invention has a polystyrene equivalent molecular weight of at least 100,000 as measured by size exclusion chromatography, as described in U.S. Pat. No. 5,330,876.

To obtain a laser-induced, ablative image using the process of the invention, a diode laser is preferably employed since it offers substantial advantages in terms of its small size, low cost, stability, reliability, ruggedness, and ease of modulation. In practice, before any laser can be used to heat an ablative recording element, the element must contain an infrared-absorbing material, such as pigments like carbon black, or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the dye, but also on the ability of the dye layer to absorb the radiation and convert it to heat. The infrared-absorbing material or dye may be contained in the dye layer itself or in a separate layer associated therewith, i.e., above or below the dye layer. As noted above, the laser exposure in the process of the invention takes place through the dye side of the ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

Any image dye can be used in the ablative recording element employed in the invention provided it can be ablated by the action of the laser and has the characteristics described above. Especially good results have been obtained with dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

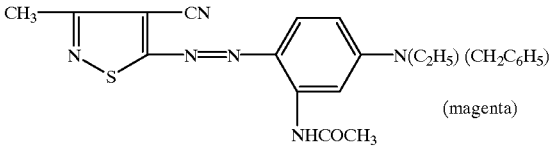

(magenta)

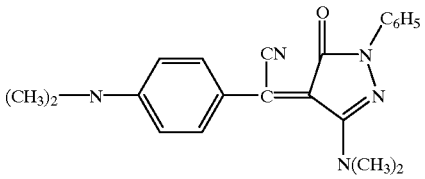

(magenta)

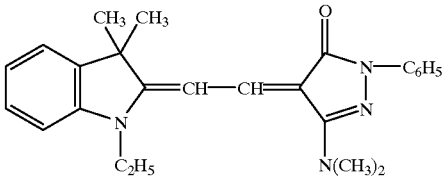

(yellow)

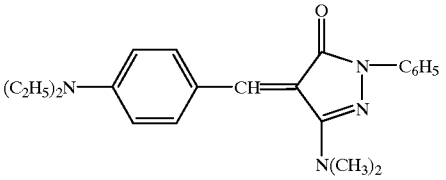

(yellow)

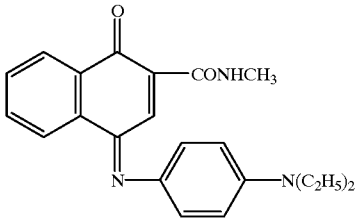

(cyan)

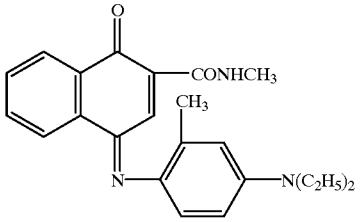

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye layer of the ablative recording element employed in the invention may be coated on the support or printed thereon by a printing technique such as a gravure process.

Any material can be used as the support for the ablative recording element employed in the invention provided it is dimensionally stable and can withstand the heat of the laser. Such materials include polyesters such as poly(ethylene naphthalate); poly(ethylene terephthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 $\mu$m. In a preferred embodiment, the support is transparent.

The following examples are provided to illustrate the invention.

EXAMPLE 1

The structural formulas of the dyes referred to below are:

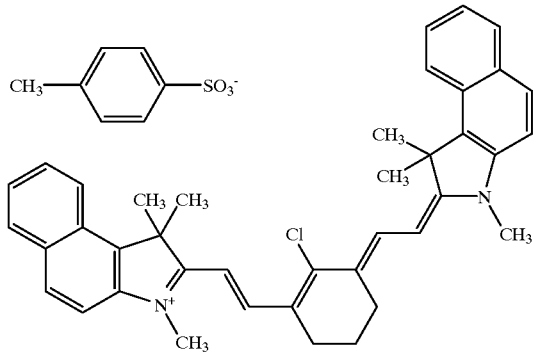

Infrared-Absorbing Dye

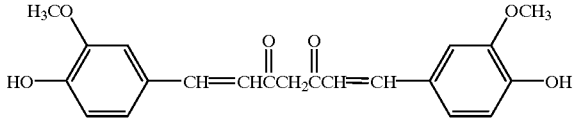

Yellow Dye

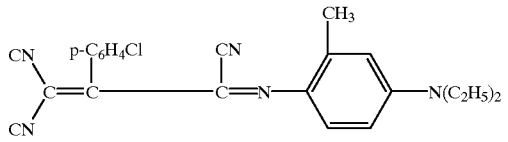

Cyan Dye

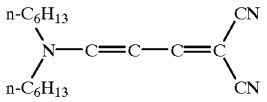

Liquid UV-Absorbing Dye

Monocolor media sheets according to the invention were prepared by coating a 100 $\mu$m poly(ethylene terephthalate) (PET) support with a layer composed of 0.60 g/m$^2$ of 1000 s. cellulose nitrate (manufactured and distributed by Aqualon Co.), 0.13 g/m$^2$ of the above UV dye, 0.28 g/m$^2$ of the above yellow dye, 0.16 g/m$^2$ of the above cyan dye, and 0.22 g/m$^2$ of the above IR-absorbing dye.

The printer used for laser-induced dye-ablative imaging was a Spectra Diode Labs laser Model SDL-2432 and contained an array of 250 milliwatt lasers with a wavelength range from 800–830 nm; the average power at the focal plane was 90 milliwatts. The 53 cm drum was rotated at a speed of 200 rev/min to provide an energy of 508.5 mijoule/cm$^2$. The nominal spot size was 25 $\mu$m.

The monocolor media sheets prepared as described above were provided with the following overcoat compositions for subsequent testing:

Control (C-1)

0.11 g/m$^2$ Zar Aqua Gloss® Polyurethane, available from United Gilsonite Labs, and 0.02 g/m$^2$ 10G® Surfactant, a nonylphenoxy polyglycidol available from Olin Corp.

Control (C-2)

Same as C-1 except that 0.11 g/m$^2$ 1000 s. cellulose nitrate was coated instead of the polyurethane, and the 10G Surfactant was omitted.

Test Samples X-1 throuah X-14 and Y-2 through Y-13

For each test sample shown in Tables 1 and 2 below, 0.16 g/m$^2$ of beads BD1 through BD14, as identified below, was incorporated in the coating solution.

Beads Used in Test Samples

BD1: MP-100 Teflon® beads ~2 μm; manufactured by DuPont Corp.

BD2: MPP635VF polyethylene wax beads 7–9 μm; available from Micro Powders, Inc.

BD3: Polyfluo 200®, 10–12 μm polyethylene/polytetrafluoro-ethylene beads; available from Micro Powders, Inc.

BD4: MicroPro 600VF®, polypropylene wax beads 7–9 μm; available from Micro Powders, Inc.

BD5: Polyfluo 523XF®, 6–8 μm polyethylene/polytetrafluoro ethylene beads; available from Micro Powders, Inc.

BD6: Zeosyl 200®, silica beads 5 μm; available from J. M. Huber Corp.

BD7: Zeo 49® silica beads 9 μm; available from J. M. Huber Corp.

BD8: Tospearl 145®, SR344 silicone resin powder; available from General Electric Co.

BD9: Montan wax; available from Shamrock Technology Inc.

BD10: Candelilla wax; available from Frank B. Ross Co.

BD11: X150P6 Spherical Hollow Spheres; available from Potters Industries Inc.

BD12: Neptune 5198®, 12 μm polyethylene wax; available from Shamrock Technology Inc.

BD13: S483, 6.5 μm polyethylene wax; available from Shamrock Technology Inc.

BD14: S363, 5 μm polypropylene wax; Shamrock Technology Inc.

BD15: 8.3 μm 90:10 styrene/crosslinked divinylbenzene beads

The samples were printed and the gloss level of the films in the unprinted (Dmax) and printed (Dmin) areas was measured using a Glossgard System gloss meter manufactured by Pacific Scientific, Gardner Laboratory Division, measuring at an angle of 85 degrees. The UV Dmax and Dmin densities were measured using a model 361-T X-Rite densitometer (X-Rite Corp.). The following results were obtained:

TABLE 1

| SAMPLE | BEAD # | UV Density Dmax | UV Density Dmin | GLOSS in Dmax area | GLOSS in Dmin area |
|---|---|---|---|---|---|
| C-1 | none | 3.57 | 0.37 | 94.4 | 96.6 |
| X-1 | BD1 | 3.96 | 0.30 | 87.2 | 77.6 |
| X-2 | BD2 | 3.53 | 0.41 | 44.8 | 49.9 |
| X-3 | BD3 | 3.60 | 0.45 | 48.7 | 59.3 |
| X-4 | BD4 | 3.54 | 0.32 | 87.7 | 90.9 |
| X-5 | BD5 | 3.57 | 0.33 | 81.1 | 76.7 |
| X-6 | BD6 | 3.61 | 0.40 | 12.0 | 24.7 |
| X-7 | BD7 | 3.61 | 0.41 | 20.4 | 43.2 |
| X-8 | BD8 | 3.56 | 0.36 | 65.5 | 69.1 |
| X-9 | BD9 | 3.60 | 0.39 | 62.0 | 65.4 |
| X-11 | BD11 | 3.46 | 0.39 | 55.5 | 62.3 |
| X-13 | BD13 | 3.57 | 0.36 | 75.1 | 71.5 |
| X-14 | BD14 | 3.64 | 0.35 | 38.4 | 78.7 |

TABLE 2

| SAMPLE | BEAD # | UV Density Dmax | UV Density Dmin | GLOSS in Dmax area | GLOSS in Dmin area |
|---|---|---|---|---|---|
| C-2 | none | 3.60 | 0.30 | 98.4 | 88.4 |
| Y-2 | BD2 | 2.95 | 0.37 | 67.9 | 59.0 |
| Y-3 | BD3 | 2.93 | 0.36 | 71.7 | 70.8 |
| Y-4 | BD4 | 2.98 | 0.36 | 64.7 | 70.4 |
| Y-5 | BD5 | 2.79 | 0.39 | 33.6 | 54.7 |
| Y-6 | BD6 | 3.31 | 0.38 | 33.0 | 22.5 |
| Y-7 | BD7 | 3.58 | 0.34 | 63.7 | 66.7 |
| Y-8 | BD8 | 2.78 | 0.35 | 60.9 | 64.7 |
| Y-9 | BD9 | 3.22 | 0.35 | 60.7 | 72.1 |
| Y-10 | BD10 | 3.08 | 0.35 | 63.7 | 77.4 |
| Y-11 | BD11 | 3.18 | 0.36 | 45.4 | 45.1 |
| Y-12 | BD12 | 2.30 | 0.37 | 54.6 | 59.5 |
| Y-13 | BD13 | 2.77 | 0.39 | 51.2 | 69.2 |

The above results show that the addition of beads in the overcoat provides a lower gloss than that of the control, even in the Dmin region. The lower gloss in the Dmin areas is surprising in that it was expected that all beads would have been ablated upon printing.

The lower gloss readings also means that the samples will have better visual fingerprint resistance, as is well known to those skilled in the art.

EXAMPLE 2

A surface friction test series was run with samples prepared by coating on a 100 μm PET support a solution of 0.11 g/m$^2$ Witco 160 (a dispersed aqueous polyurethane available from Witco Co.), 5 mg of beads as identified in Table 3, and 0.01 g/m$^2$ of surfactant as identified in Table 3. The surface coefficient of friction was measured using the IMASS paper clip friction test. This test was conducted on a modified Slip Peel Tester (Model SP-102B-3M90 from Instrumentor, Inc., Strongville, Ohio) which measures the force necessary to cause a standard paper clip to slip. The following results were obtained:

TABLE 3

| BEAD | SURFACTANT | UV Dmin | PAPER CLIP TEST |
|---|---|---|---|
| BD1 | SF1 | .184 | .11 |
| BD14 | SF2 | .204 | .15 |
| BD15 | SF3 | .206 | .23 |
| No overcoat | | N/M | .44 |

N/M = not measured
SF1 = 1:1 Zonyl FSN-100 ®, a nonionic surfactant available from DuPont Corp./FC-129 ®, a fluorocarbon surfactant available from 3M Corp.
SF2 = 1:1 Zonyl FSN-100 ®/Sodium Dodecyl Sulfate
SF3 = Zonyl FSN-100 ®

The above results show that the surface friction is readily modified by the beads or particles contained in the overcoat. In all cases the beads have reduced the surface friction. It is well known in the art that a reduction in surface friction will reduce abrasion by resisting the tendency of the abrading material to start a scratch, and instead allowing it to slide over the surface.

The invention has been described in detail with particular reference to preferred embodiments thereof, but it will be understood that variations and modifications can be effected within the spirit and scope of the invention.

What is claimed is:

1. A process of forming a single color, ablation image having an improved scratch resistance comprising imagewise heating by means of a laser, in the absence of a separate receiving element, a dye-ablative recording element comprising a support having thereon, in order, a dye layer comprising an image dye dispersed in a polymeric binder and a polymeric overcoat layer which contains polytetrafluoroethylene beads but which does not contain any image dye, said polvmeric overcoat layer comprising a polyurethane, cellulose nitrate, cellulose acetate propionate, aelatin or a polyacrylate, said dye layer having an infrared-absorbing material associated therewith to absorb at a given wavelength of said laser used to expose said element, said image dye absorbing in the region of the electromagnetic spectrum of from about 300 to about 700 nm and not having substantial absorption at the wavelength of said laser used to expose said element, said laser exposure taking place through the dye side of said element, and removing the ablated material to obtain an image in said ablative recording element.

2. The process of claim 1 wherein said beads have a particle size from about 5 to about 50 $\mu$m and are present at a concentration of from about 0.005 to about 5.0 g/m$^2$.

3. The process of claim 1 wherein said infrared-absorbing material is a dye which is contained in said dye layer.

4. The process of claim 1 wherein said support is transparent.

5. The process of claim 1 wherein a barrier layer is present between said support and said dye layer.

* * * * *